US005097958A

United States Patent [19]

Josephs et al.

[11] Patent Number: 5,097,958

[45] Date of Patent: Mar. 24, 1992

[54] CARTON AND BLANK AND METHOD OF FORMING THE CARTON FROM A BLANK

[75] Inventors: Patricia Josephs; Sherry Arnold, both of Williamsburg, Va.

[73] Assignee: Somerville Packaging, A Division of Paperboard Industries, Newport News, Va.

[21] Appl. No.: 599,982

[22] Filed: Oct. 19, 1990

[51] Int. Cl.[5] ..... B65D 5/54

[52] U.S. Cl. ..... 229/227; 229/905

[58] Field of Search ..... 229/160, 145, 905; 206/608, 611, 615, 626, 624

[56] References Cited

U.S. PATENT DOCUMENTS

| | | | |
|---|---|---|---|
| 610,255 | 9/1898 | Bisler . | |
| 635,377 | 7/1899 | Ferrell . | |
| 998,109 | 7/1911 | Morlan . | |
| 1,080,190 | 12/1913 | Bauer . | |
| 1,372,218 | 3/1921 | Davidson . | |
| 2,648,484 | 8/1953 | Belsinger . | |
| 2,791,364 | 5/1957 | Bergstein et al. | 229/160 |
| 3,097,783 | 7/1963 | Burt | 229/37 |
| 3,337,030 | 8/1967 | Miller . | |
| 3,572,576 | 5/1969 | Foster . | |
| 3,854,651 | 12/1974 | Osborne . | |
| 4,101,022 | 7/1978 | Watkins | 206/45.14 |
| 4,555,027 | 11/1985 | Froom | 206/626 |
| 4,712,689 | 12/1987 | Froom | 206/626 |
| 4,749,086 | 6/1988 | Donohie | 206/611 |
| 4,819,864 | 4/1989 | Capuano | 229/905 |
| 4,826,074 | 5/1989 | DePaul | 229/132 |
| 4,907,698 | 3/1990 | Konrad et al. | 229/905 |

FOREIGN PATENT DOCUMENTS 651573 1/1953 Italy .

*Primary Examiner*—Stephen Marcus
*Assistant Examiner*—Christopher J. McDonald
*Attorney, Agent, or Firm*—Shlesinger Arkwright & Garvey

[57] ABSTRACT

A blank and carton and method of carton construction for packaging ice cream or the like. The blank includes a front, bottom, rear, cover and closure flap hingedly connected in the order named. Each front bottom rear cover and closure flap includes right and left end flaps hingedly connected to its respective panel. Membrane flaps are hingedly connected to the right and left end flaps of the bottom panel for forming a lip when the carton is constructed to prevent the accidental escape of liquid from the interior of the carton.

1 Claim, 9 Drawing Sheets

CARTON AND BLANK AND METHOD OF FORMING THE CARTON FROM A BLANK

FIELD OF THE INVENTION

This invention pertains to a blank and a carton and method of forming the carton from a blank for packaging semi-liquids such as ice cream or the like. The formed carton permits a consumer to readily reseal carton subsequent to the initial opening thereof.

BACKGROUND OF THE INVENTION

Many important factors must be taken into account in the construction of ice cream cartons. Desirable features include the minimization of scrap stock material from which the blanks are formed, the use of carton blank designs which minimize or eliminate mechanical changes in carton manufacturing and erecting machinery, providing a carton which is resealable after initial opening and providing a carton which will prevent leakage of the enclosed product when exposed to thawing temperatures. The prevention of leakage in ice cream cartons is very important because consumers will tend to avoid cartons of ice cream having sticky ice cream residue on the exterior thereof. The potential for leakage arises with slight exposure of a portion of a carton to above freezing temperatures because the ice cream in contact with the interior carton wall will liquify. With proper carton construction leakage can be avoided.

Several attempts have been made to provide seals to prevent liquified ice cream from leaking and have included various configurations of side flaps to provide a secure closure.

OBJECTS AND SUMMARY

One of the most important objects of this invention is to provide an improved blank and carton, for packaging semi-liquids such as ice cream or the like.

Another object of the invention is to provide a carton blank which can be easily erected by mechanical devices and minimizing waste stock material.

A further object of the invention is to provide a carton that can be easily resealed after the initial opening thereof by a consumer.

Yet another object of the invention is to provide a carton having a superior seal.

Still another object of the invention is to provide a carton which can be manufactured and stored as a tube and then erected and filled.

Another object of the invention is to provide a closure flap having enlarged sealing tabs thereon to provide added glue application area.

A further object of the invention is to provide an improved tear strip on a corner flap which secures the cover flap to the panel side flaps during shipping yet allows the carton to be easily opened by the consumer.

In summary, the present invention is a novel carton blank for forming a tube and a carton for packaging ice cream or the like and method of folding to form the carton comprising connected cover, front, bottom and rear panel wherein the cover and bottom panels have front, rear, left and right edges and the front and rear panels have top, bottom, left and right edges and the closure flap is hingedly connected to the front edge of the cover panel and the rear panel is hingedly connected at its top edge to the rear edge of the cover panel and the bottom panel is hingedly connected at its rear edge to the bottom edge of the rear panel. The front panel is hingedly connected at its bottom edge to the front edge of the bottom panel and each of the panels include left and right end flaps connected to the left and right edges respectively and forming hinge lines therebetween, the left and right end flaps including top, bottom, rear and front edges and left end flaps being dimensioned such that when folded the left end of the carton is substantially sealed and the right end flaps being dimensioned such that when folded, the right end of the carton is substantially sealed and the left and right bottom panel end flaps when folded, being folded in first and each forming an interior wall of the carton. Each of the left and right bottom panel end flaps have a membrane flap connected thereto along the top edge thereof to substantially seal the ends of the carton to prevent leakage therefrom. The left and right front panel end flaps when folded only overlap a portion of the corresponding bottom panel end flaps and the left and right cover panel end flaps when folded form a portion of the exterior end wall of the carton. The cover panel end flaps overlap at least a portion of the corresponding front and bottom panel end flaps when folded and the left and right rear panel end flaps when folded, form at least a portion of the exterior wall of the carton and the rear panel end flaps when folded overlap at least a portion of the corresponding bottom panel end flaps.

DETAILED DESCRIPTION OF THE INVENTION

Figure 8:
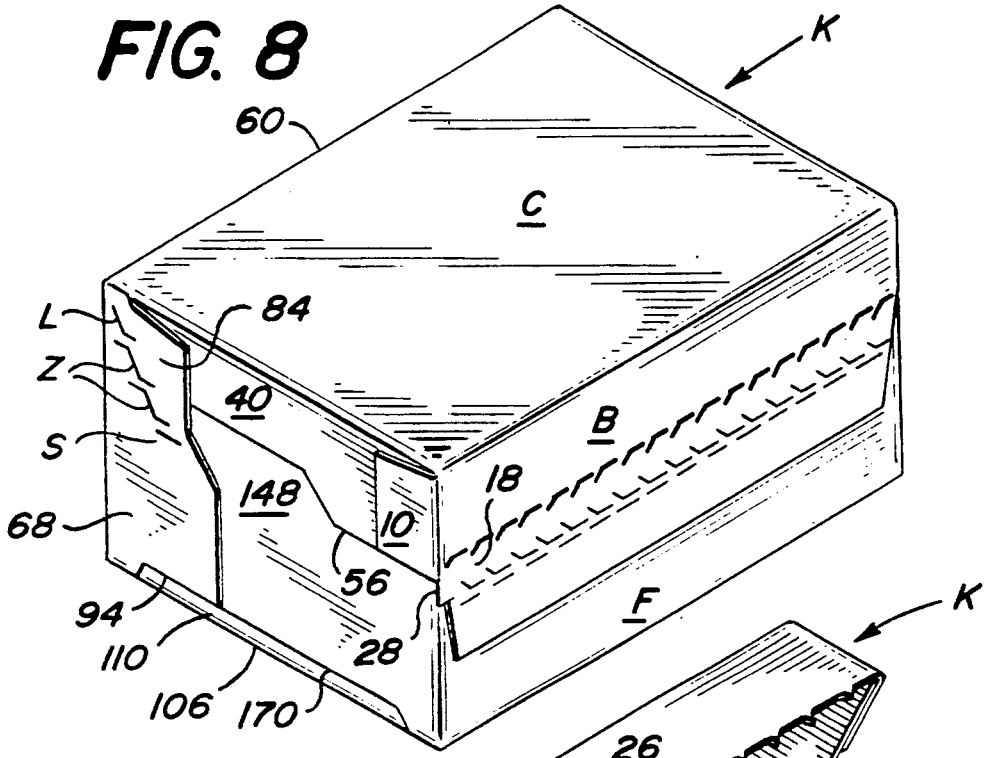
FIG. 8 is a fragmentary perspective view of the carton blank with the left end completely sealed.

The specific nomenclature assigned to each component and subcomponent comprising the carton blank A refers to its orientation when fully erected as viewed in FIG. 8.

Figure 1:
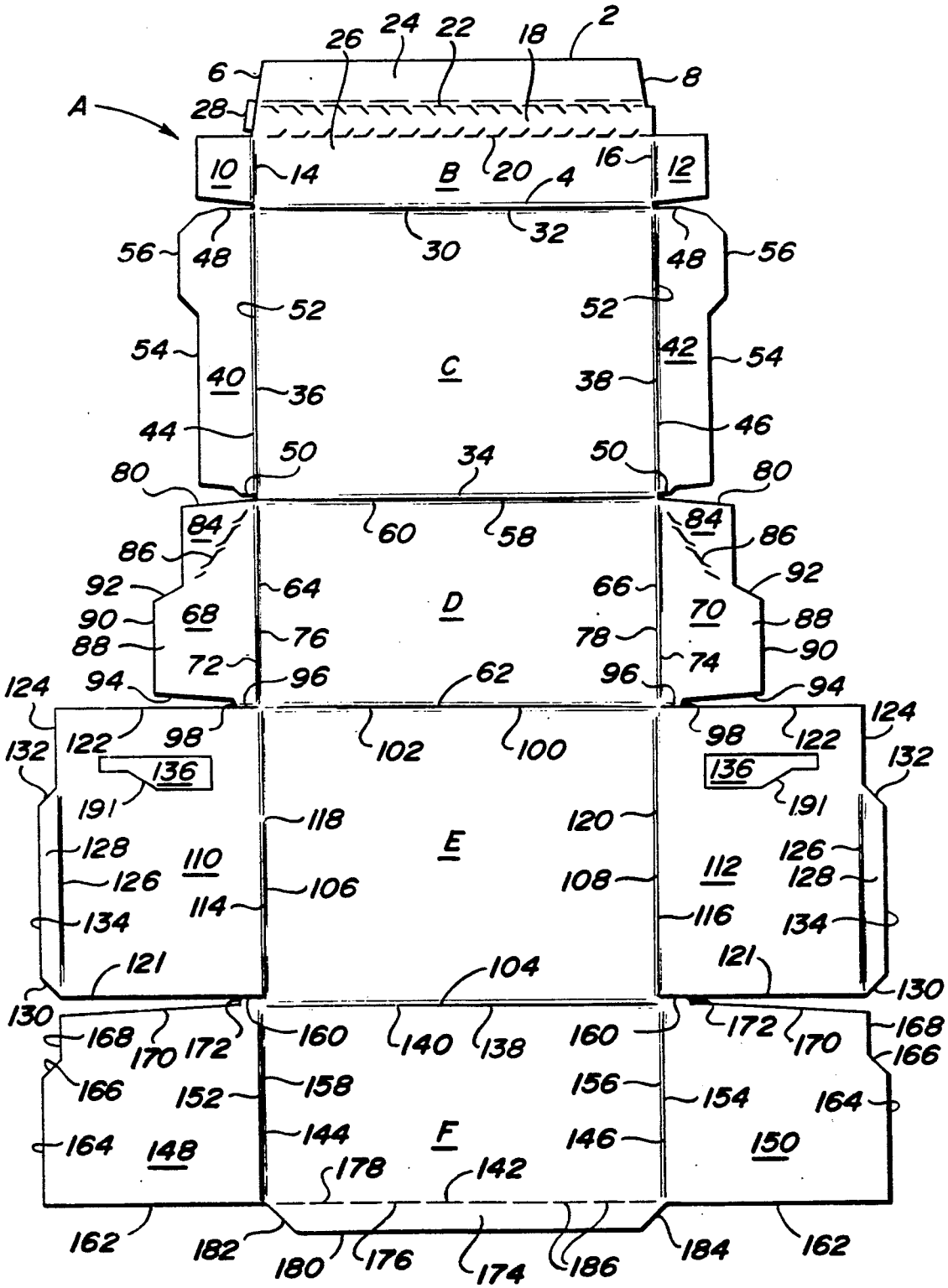
FIG. 1 is a plan view of the inner surface of a flat carton blank formed in accordance with the present invention.

Referring now to the drawings and more specifically to FIG. 1 a carton blank A is shown having a closure flap B, a cover panel C, a rear panel D, a bottom panel E and a front panel F.

Closure flap B includes a top edge 2, and bottom edge 4, a left edge 6, and a right edge 8. Left and right cover or glue tabs 10 and 12 are hingedly connected to left and right edges 6 and 8, respectively. Vertically extending hinge lines 14 and 16 are formed therebetween. A tear strip 18 is formed in closure flap B for detaching the cover panel C from the front panel F. Tear strip 18 includes spaced weakness lines 20 and 22. Weakness lines 20 and 22 divide closure flap B into a glue panel or segment 24 and a skirt or resealable flap 26. Glue panel 24 will remain adhered to the exterior of front panel F when tear strip 18 is removed by a consumer.

A tear tab 28 is formed in tear strip 18, preferably along left edge 6. Tear tab 28 enables a consumer to grasp and remove tear strip 18 to gain access to the contents of the carton A. It will be appreciated by one of ordinary skill in the art that various other types of tear tabs may be used.

Cover panel C is hingedly connected at its front edge 30 to top edge 4 of closure flap B forming a horizontally extending hinge line 32. Cover panel C further includes rear edge 34, left edge 36 and right edge 38. End flaps 40 and 42 are hingedly connected to left and right edges 36 and 38, respectively of cover panel C and form vertically extending hinge lines 44 and 46.

Cover panel end flaps 40 and 42 include front, rear, top, and bottom edges 48, 50, 52 and 54 respectively. Left flap 40 and right flap 42 each include ears 56 extending from the bottom edges 54. Ears 56 provide enlarged areas for glue tabs 10 and 12 to adhere to left flap 40 and right flap 42, respectively.

Rear panel D is hingedly connected at its top edge 58 to rear edge 34 of cover panel C forming a horizontally extending hinge line 60 therebetween. Rear panel D also includes bottom, left and right edges 62, 64 and 66, respectively. Rear panel end flaps 68 and 70 are hingedly connected at their edges 72 and 74 to left and right edges 64 and 66 of rear panel D, respectively forming vertically extending hinge lines 76 and 78, respectively.

Figure 6:
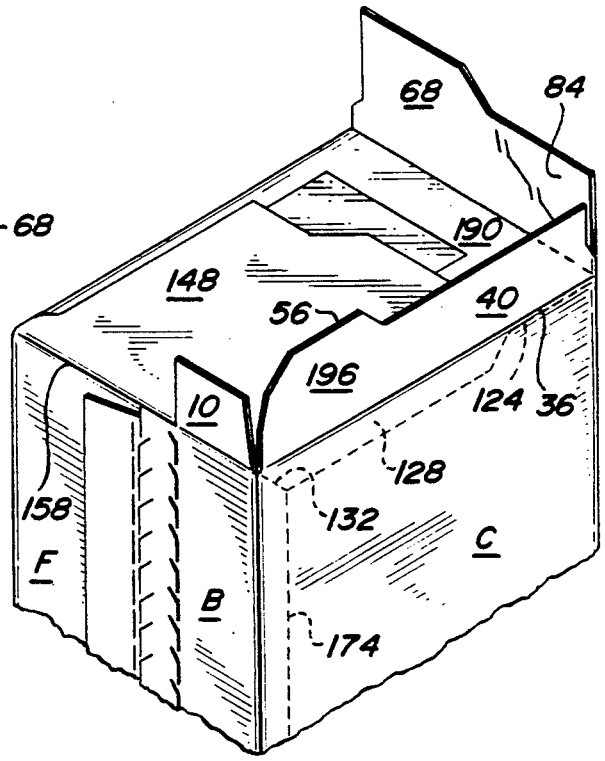
FIG. 6 is a perspective view of the opened carton with the tear strip removed.
Figure 7:
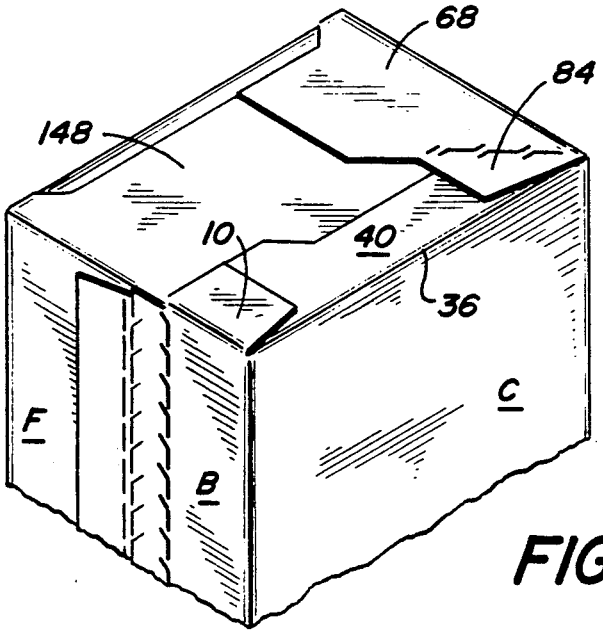
FIG. 7 is a fragmentary perspective view of the carton blank with the left front and left bottom panel end flaps folded inwardly.

Rear panel end flaps 68 and 70 are defined by angled top edges 80 and side edges 82 which form the edges of corner flaps 84. Each corner flap 84 is separable from its respective side flap 68 or 70 by tearing along weakness line 86 as the cover panel C is opened to gain access to the carton contents as best shown in FIG. 6.

Weakness line 86 is formed by a series of serrations to cause easy separation of corner flap 84 from its respective end flap 68 or 70. The shape of the serrations is very important in providing the required amount of tear resistance so that the flap 84 will not be disengaged from the end flap 68 or 70 prematurely, such as during shipping yet be torn readily to access the contents of the carton K. The preferred shape of the serrations is a stretched L-shaped cut identified by the L in FIG. 8 followed by a pair of stretched Z-shaped denoted by Z cuts followed by a straight cut denoted by S. The central portions of the Z cuts are aligned with each other and the longer portion of the L cut.

End flaps 68 and 70 also include extensions 88 having a vertical side edge 90 and inclined top edge 92 and inclined bottom edges 94. Each right and left end flap 68 and 70 have a horizontal base edge 96 connected to the inclined bottom edge 94 of extensions 88 by an inclined side edge 98. Bottom panel E is hingedly connected at its rear edge 100 to bottom edge 62 of rear panel D forming a horizontally extending hinge line 102. Bottom panel E further includes front edge 104, left edge 106 and right edge 108. End flaps 110 and 112 are hingedly connected at their bottom edges 114 and 116 to the left and right edges 106 and 108 of the bottom panel E, respectively forming hinge lines 118 and 120 therebetween. Hinge lines 118 and 120 are inwardly off-set from hinge lines 76 and 78, respectively.

Figure 2:
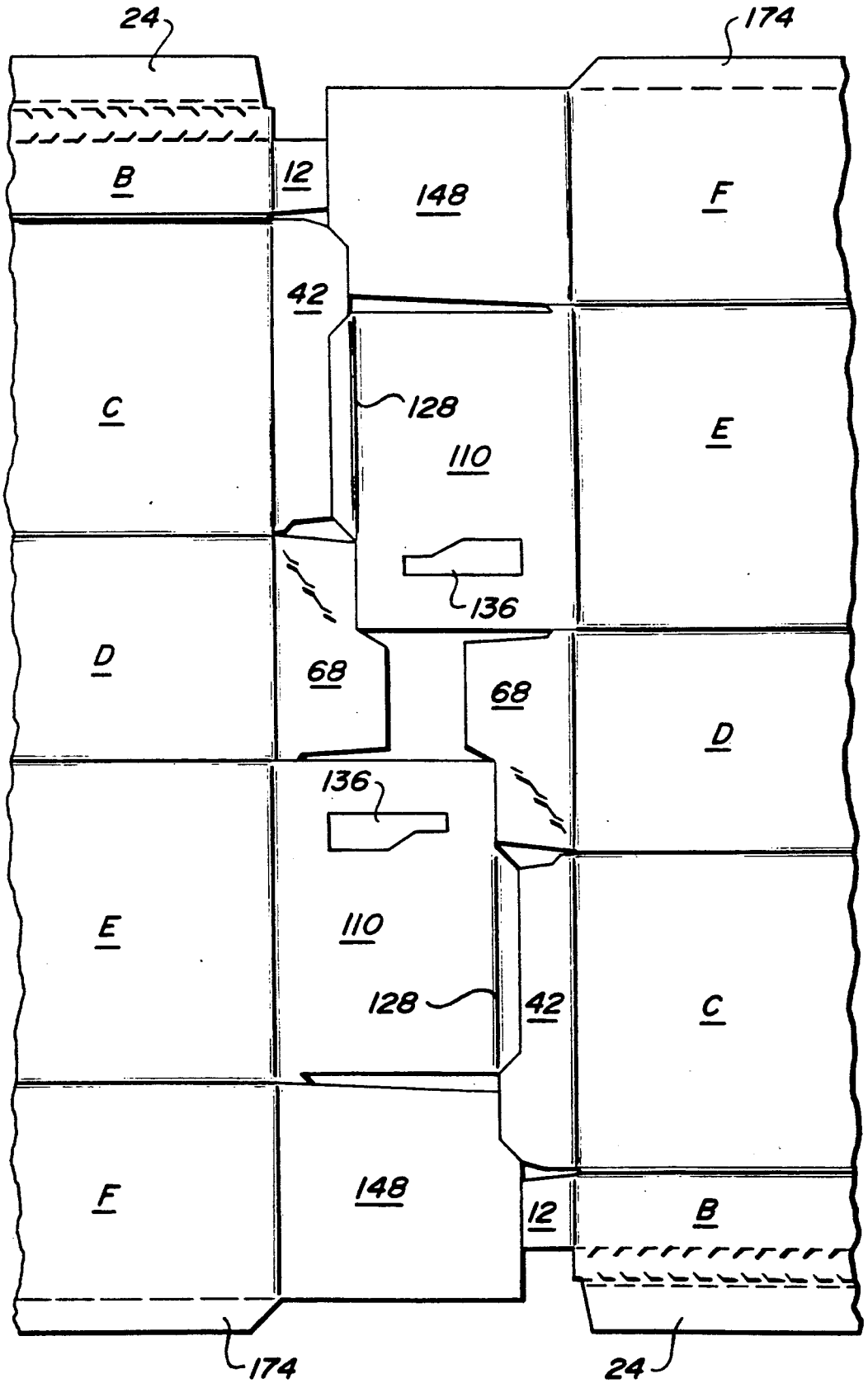
FIG. 2 is a fragmentary plan view of a pair of carton blanks illustrating their orientation during the blanking operation.

Left and right flaps 110 and 112 include front edges 121 and rear edges 122. Rear edges 122 are substantially collinear with rear edge 100 when the blank is positioned as shown in FIG. 1. Front edges 121 are substantially collinear with edge 104. Preferably front edges 121 and rear edges 122 are slightly tapered inwardly from bottom panel E to side edge 124. Left and right flaps 110 and 112 have side edges 124. Collinear with side edge 124 is a hinge line 126 along which a membrane flap 128 is hingedly connected to each of left and right flaps 110 and 112. The hinge line 126 adjusts for the thickness of membrane 128 so that when membrane 128 is folded substantially 90° from flaps 110 and 112, membrane flap 128 is aligned with side edge 124 to form a smooth cover flap engagement surface. Membrane flap 128 includes inclined front and rear edges 130 and 132 respectively and a substantially straight side edge 134. Membrane flap 128 as shown in FIG. 1 extends, only partially along side edge 124. As shown in FIG. 2, the reason for this is to conserve paper stock yet retain a large adhesion surface on ears 56. Membrane flap 128 could be extended across the entire top edge 124 of bottom flaps 110 and 112.

Each left and right flap 110 and 112 includes an embossment 136 thereon to provide a better adhesive surface when the exterior side flaps 68 and 70 are adhered thereto. The preferred shape of the embossed area will be discussed during the carton erecting sequence.

Front panel F includes a bottom edge 138 which is connected to front edge 104 of bottom panel E along hinge line 140 extending horizontally therebetween. Front panel F further includes a top edge 142, a left edge 144 and a right edge 146. End flaps 148 and 150 are hingedly connected to left and right edges !52 and 154 of front panel F, respectively, forming vertically extending hinge lines 156 and 158.

Each left flap 148 and right flap 150 includes a horizontal bottom edge 160, a horizontal top edge 162 and a vertical side edge 164. Side edge 164 includes an inclined edge 166 extending downwardly to inwardly off-set portion 168.

An upwardly inclined edge 170 extends from a sharply inclined edge 172 adjacent bottom flap edge 160 and extends outwardly to inwardly offset edge 168.

Front panel F includes a membrane flap 174 hingedly connected to top edge 142 of front panel F forming therebetween a horizontally extending hinge line 176. Front panel membrane 174 is defined by a front edge 178, a rear edge 180, a left edge 182 and a right edge 184. Hinge line 176 includes a plurality of slits 186 that extend completely through the thickness of the carton blank A. The function of slits 186 will be more fully discussed below. Left and right edges 182 and 184 extend inwardly from hinge line 176 and each forms an angle of 135° therewith. The angle of 135° corresponds with the front inclined edges 130 of membrane flap 128 which are angled from hinge line 126 an angle of 135°. Although edges 130 and 182 and 184 are cut at angles of 45° from their respective hinge lines, it would be obvious to one of ordinary skill in the art that these edges could be cut along any pair of complimentary angles such as 60° and 30°.

An adhesive H in the form of a strip or other well known form is applied to glue segment 24 of closure flap B.

Referring to FIG. 2, a pair of blanks are illustrated as oriented during the blanking operation. As is evident from the drawing, the end flaps have been designed to reduce the amount of scrap stock produced during the blanking operation and to create an efficient layout by nesting adjacent blanks.

CARTON ASSEMBLY

FIGS. 1, 3, 4 and 5

The specific steps taken to assemble the blank A will now be described. Initially, the front panel F is folded about hinge line 140 so that it lies on a portion of bottom panel E. Cover panel C and closure flap B are folded about hinge line 34 so that cover panel C overlies rear panel D, a portion of bottom panel E and front panel membrane flap 174. Closure flap B overlies front panel F so that the closure flap B extends a distance there along greater than one-half the height of the front panel F. The front edges 48 of cover end flaps 40 and 42 overlie a portion of end flaps 148 and 150, respectively.

Figure 3:
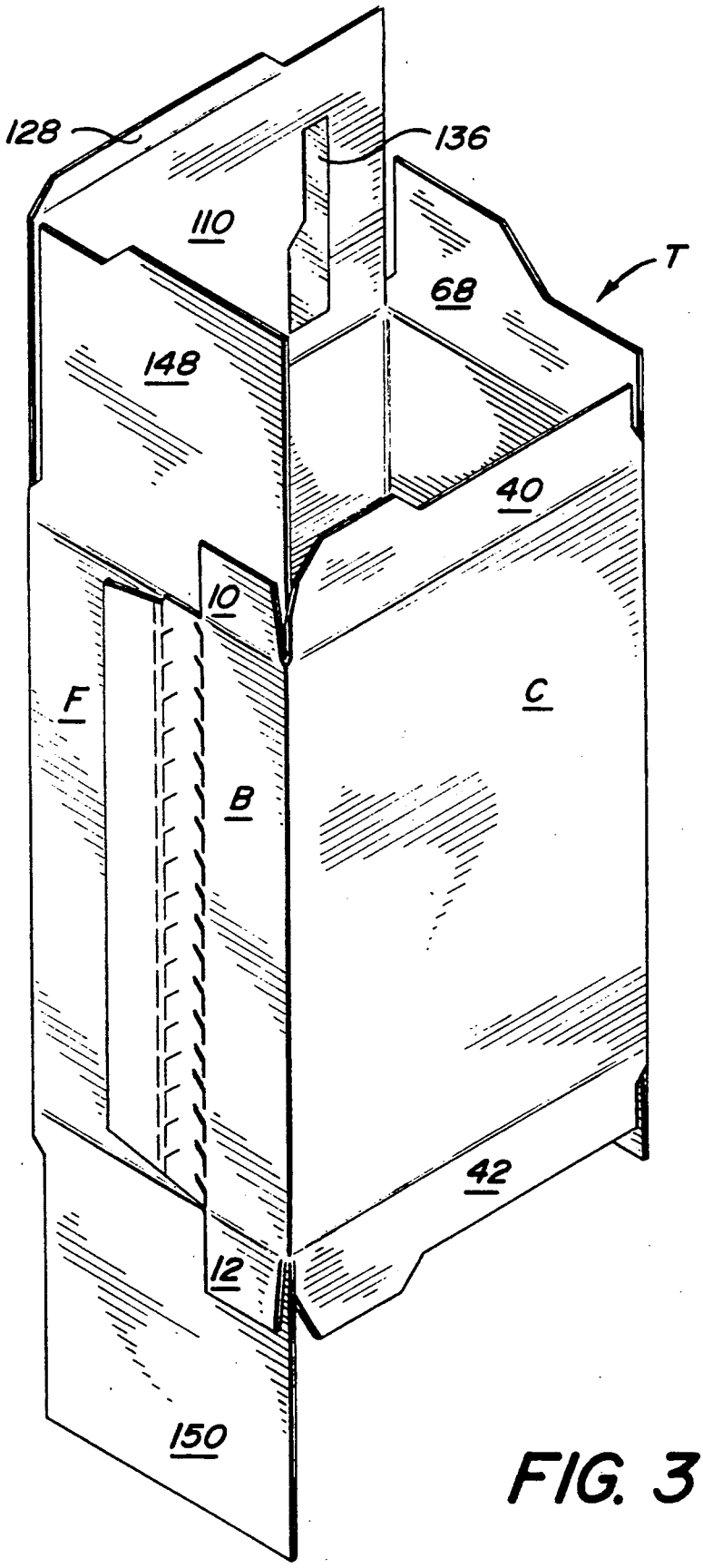
FIG. 3 is a perspective view of the carton blank with the body panels fully erected and the end flaps fully extended forming a tube.

To seal closure flap B to front panel F, pressure is applied to the exterior of closure flap B so that glue strip 24 engages front panel F to securely fasten closure flap B to front panel F. Next, carton A can be erected to form a tube T as shown in FIG. 3. Forming the tube T is commonly known as "squaring" the carton K. This means that the corners form 90° angles. The formed carton K generally remains oblong.

At this stage in the assembly process, the blank A is placed into the hopper of a cartoner, i.e. a mechanical machine for erecting carton blanks. The hopper of the cartoner (not shown) is designed to hold about 250 blanks oriented in such a manner that the cover, rear, bottom and front panels are vertically positioned. Individual blanks are removed from the hopper, opened and squared into the configuration shown in FIG. 3.

Figure 4:
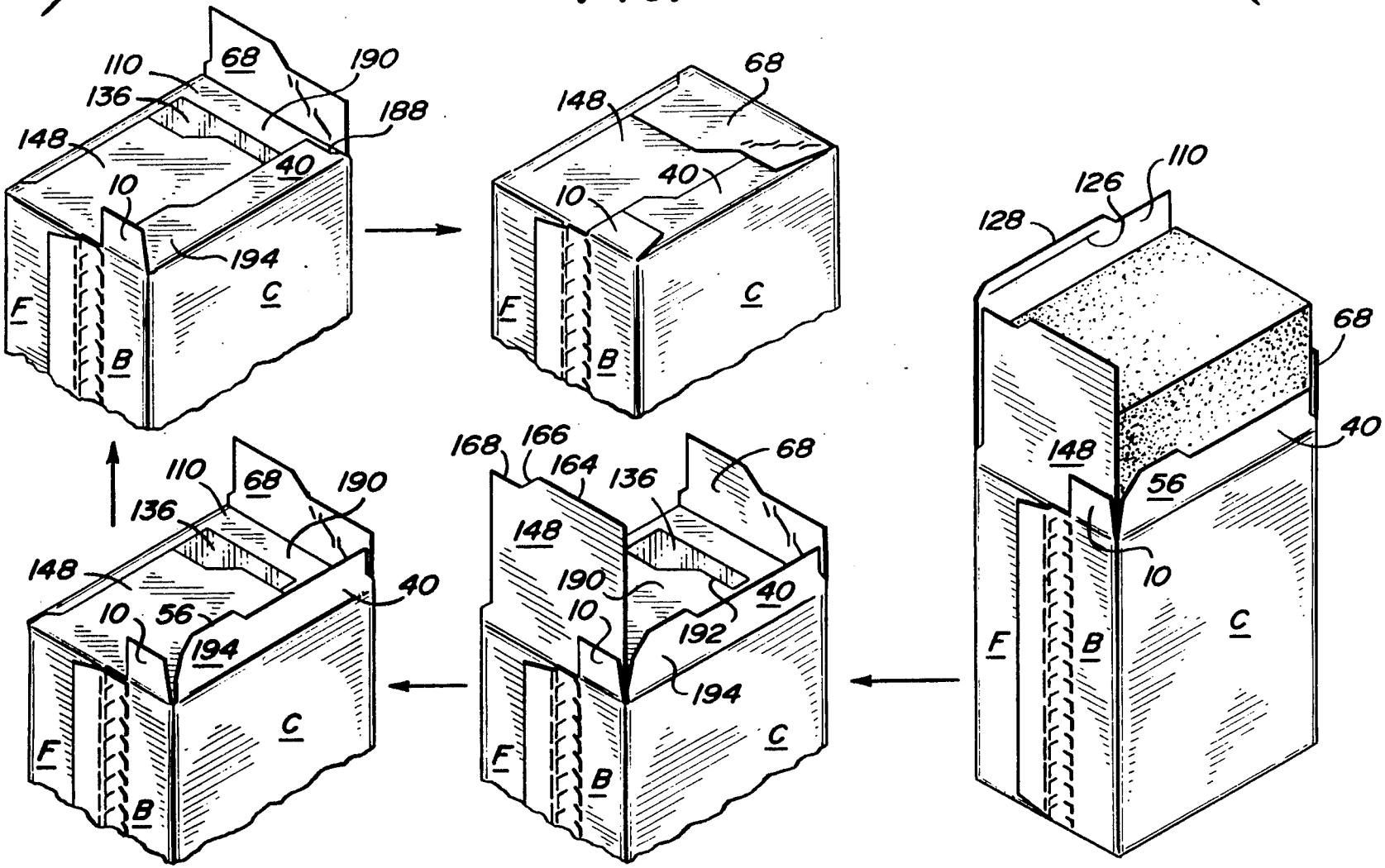
FIG. 4 is a perspective view of the filling and assembly process of the blank.
Figure 5:
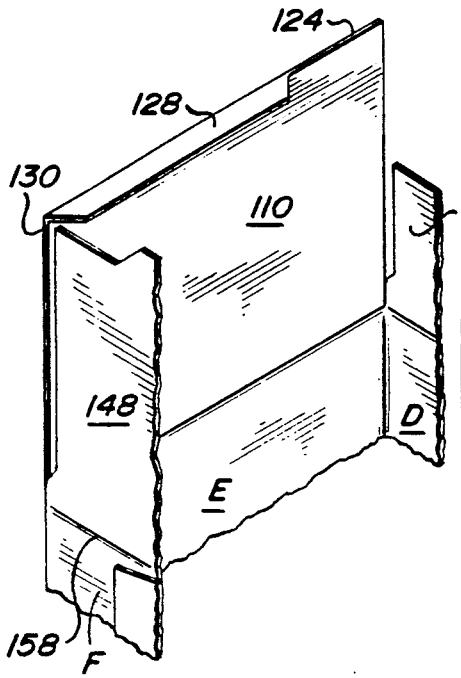
FIG. 5 is a perspective view of the sealed carton.

As the cartoner prepares blank A for filling, the right end flaps 12, 42, 112, and 150 are folded and adhesive is applied to seal the right end flaps and the carton is set upon the right end as shown in FIG. 4.

Referring now to the left end shown in FIGS. 4–7, membrane flap 128 is folded perpendicularly to left end flap 110 and as panel 110 is itself folded perpendicularly to panel E, membrane flap 128 becomes parallel to bottom panel E and top edge 124 of left end flap 110 becomes flush with and beneath left edge 36 of cover panel C. Edge 130 of membrane flap 128 complementarily abuts edge 182 of membrane flap 174. Next, left end flap 148 is folded along hinge line 158 to become parallel with left end flap 110 and perpendicular to front panel F. A strip of adhesive 188 is applied to exterior 190 of left bottom panel flap 110. Next, cover panel and end flap 40 is folded along hinge line 44 to overlie the exterior of end flaps 110 and 148.

Embossment 136 bulges outwardly from exterior 190 of bottom panel end flaps 110 and 112 forming an engagement surface for rear panel end flaps 68 and 70. The shape of the embossment edge 192 conforms to edges 164, 166 and 168 of end flaps 148 and 150 so that flaps 148 and 150 do not cover the embossments 136. Glue strip 188 extends vertically crossing embossment 136, and end flaps 148 and 40. Embossment 136 prevent flaps 68 and 70 from being flexed when glued in position, thus allowing a secure attachment of the end flaps to form a integral closure. Left end flap 68 and glue tab 10 may be folded over simultaneously. Ear 56 will have adhesive applied to their exterior surface 194 thereof prior to glue tab 10 being folded in an overlying relationship with the exterior surface 194 of ears 56. Subsequent to folding along hinge line 76 left rear end flap 68 will overlie a portion of left cover panel end flap 40 as well as the embossed area 136 of left bottom panel end flap 110 and a portion of left front panel end flap 148.

CARTON OPENING

FIG. 8 shows the carton K in the fully formed and sealed orientation. Closure flap B extends downwardly over the front panel F and the cover C seals the top of the carton K. The left side of the carton as shown having glue tab 10 adhered to the ear portion 56 of cover panel end flap 40. Corner flap 84 of rear panel end flap 68 is also adhered to cover panel end flap 40. Rear end flap 68 and cover panel end flap 40 both overlap front panel end flap 148. A portion of bottom panel end flap 110 can be seen below the inclined bottom edges 94 and 170 of end flaps 68 and 148, respectively. Inclined bottom edges 94 and 170 illustrate an important feature in carton construction. The edges 94 and 170 are offset from the edge 106 of the bottom panel to prevent inadvertent tearing or breaking of the end seal during shipping and handling of the carton.

Figure 9:
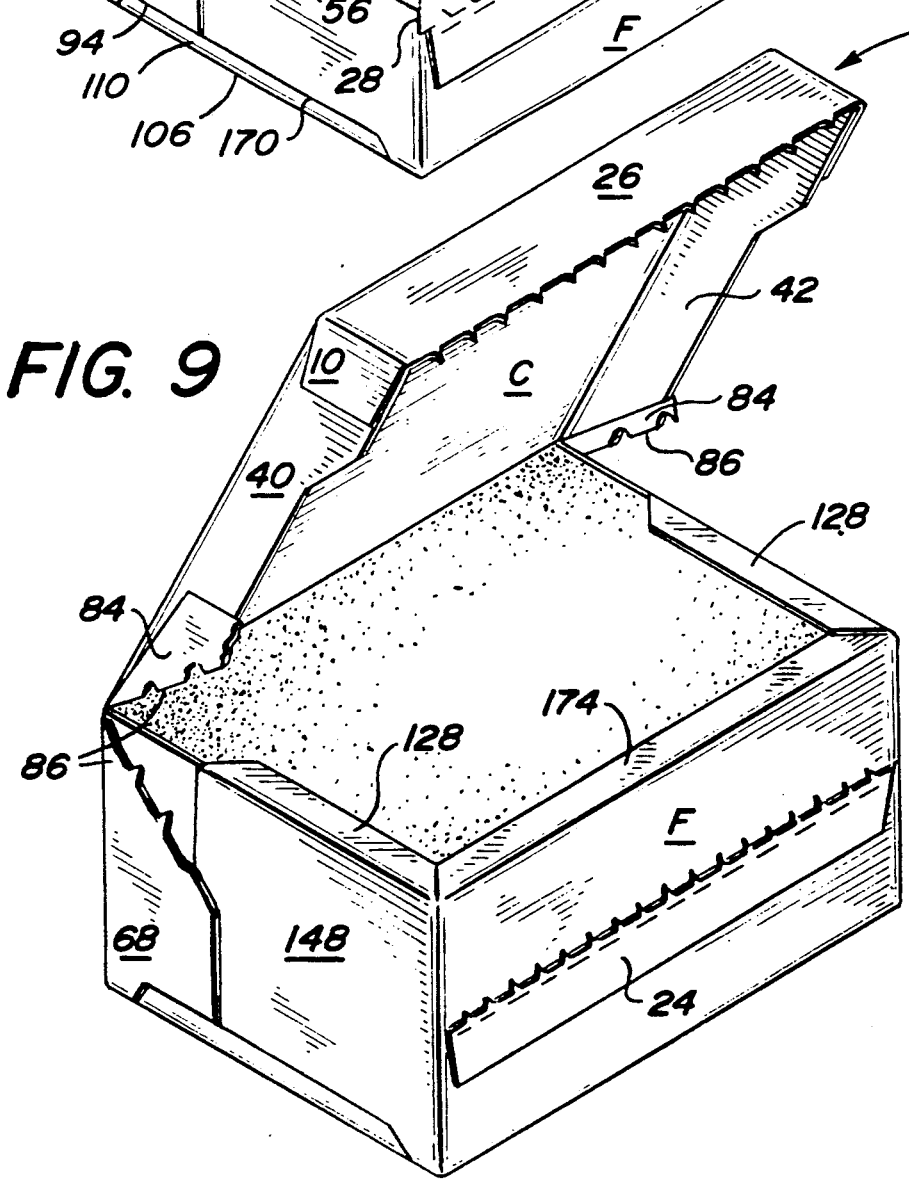
FIG. 9 is a fragmentary perspective view showing the membrane flap folded 90°.

The steps necessary to obtain access to the contents of carton K will now be explained with reference to FIGS. 8 and 9. To detach cover panel C from front panel F, tear tab 28 is grasped and pulled outwardly from front panel F which will cause tear strip 18 to separate from closure flap B. Then the consumer can bend the cover panel C backwards about hinge line 60 which will cause corner flaps 84 to separate from rear end flaps 68 and 70 along weakness line 86 to access the contents of the carton K. Corner flaps 84 will remain with cover panel end flaps 40 and 42 after opening. Glue panel 24 will remain adhered to front panel F.

Upon closing the cover panel C, skirt 26 will engage the top edge 142 of front panel F frictionally to maintain the cover panel C in the closed position after opening.

ALTERNATIVE EMBODIMENTS FOR A CARTON BLANK

FIG. 10

Figure 10:
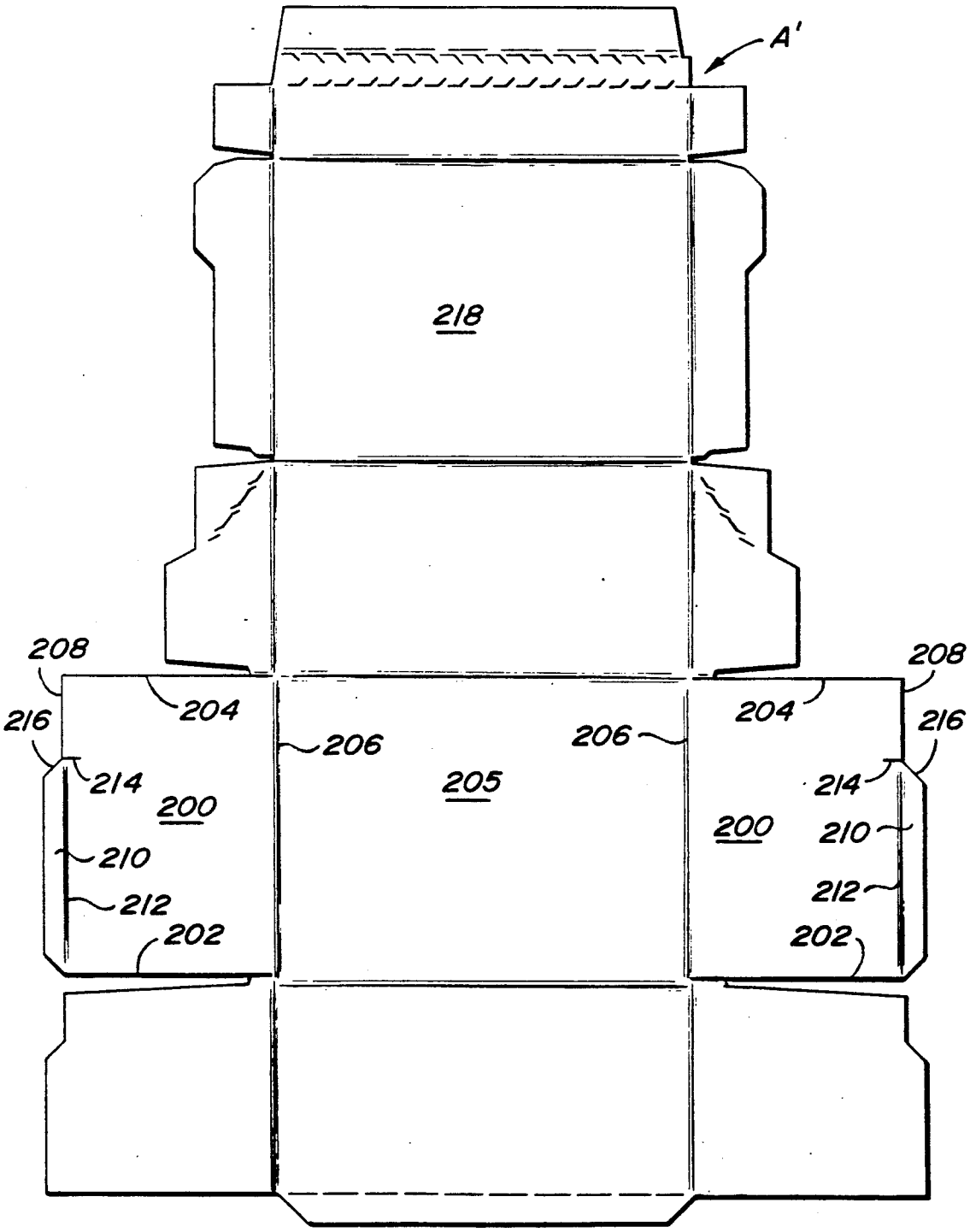
FIG. 10 is a plan view of a blank of an alternative embodiment.

FIG. 10 shows a second embodiment of the carton blank A' having right and left bottom panel end flaps 200. Each bottom panel end flap includes a front edge 202 and a rear edge 204 and each end flap 200 is hinged to the bottom panel 205 along hinge lines 206. The top edges 208 of the end flaps 200 have membrane flaps 210 hingedly connected thereto along fold lines 212. Fold lines 212 are spaced closer to hinge lines 206 than are top edges 208. A notch 214 is provided in each end flap 200 at the rear ed 216 of each membrane flap 210 which allows the membrane flap 210 to fold perpendicularly to top edge 208 so that a uniform surface is formed along the top edge 208 of the end flap 200 to provide a more effective sealing engagement with cover panel 218 when the carton is filled.

Figure 11:
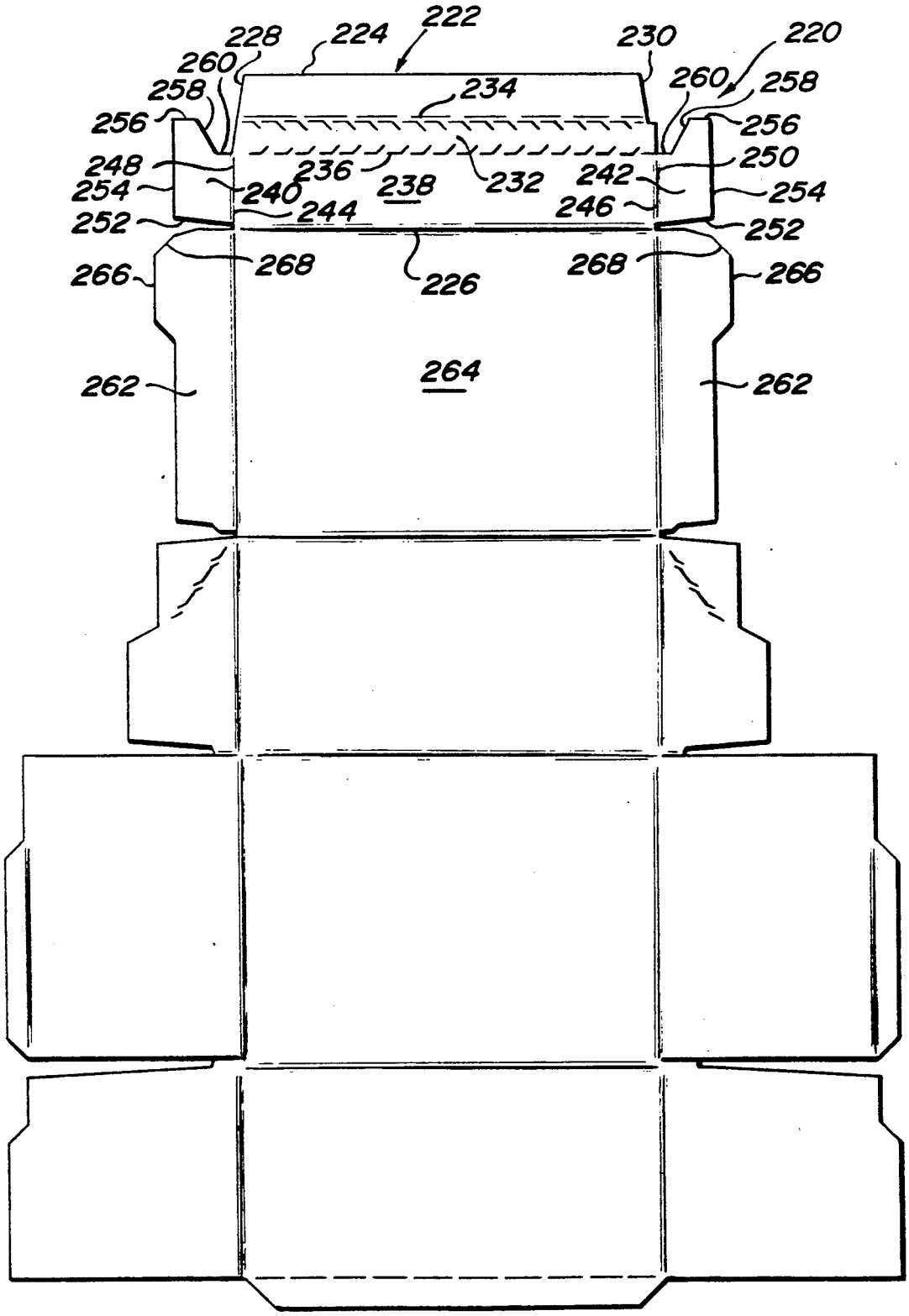
FIG. 11 is a plan view of a blank of another alternative embodiment.
Figure 12:
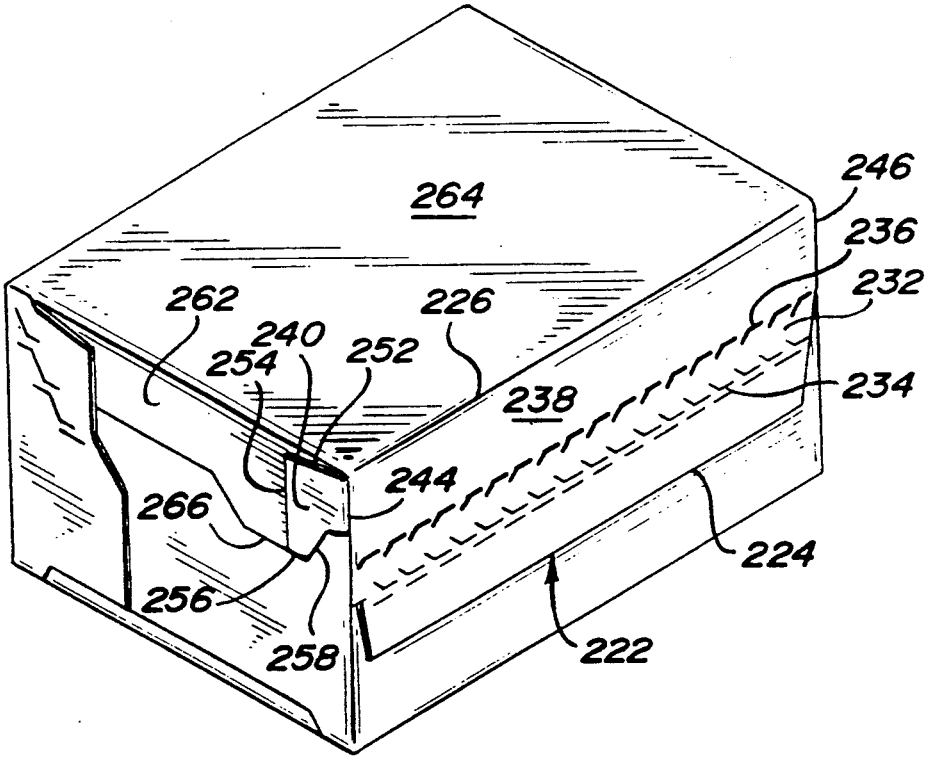
FIG. 12 is a perspective view of the carton formed from the blank of FIG. 11.

FIGS. 11 and 12

FIGS. 11 and 12 show modified carton blank 220 having a modified closure flap 222. The blank 220 is similar in all other respects to blank A of FIG. 1.

When ice cream cartons are manufactured in smaller sizes, for example one quart or one pint sizes, all of the flaps and panels are correspondingly reduced proportionally in size. In order to maintain the integrity of the sealed container, it is necessary that certain modifications be made.

As shown in FIGS. 11 and 12, closure flap 222 includes a bottom edge 224, a top edge 226, a left edge 228 and a right edge 230. A tear strip 232 is formed in the closure flap 222 between a lower line of weakness 234 and an upper line of weakness 236. A resealable flap 238 is formed between upper line of weakness 236 and top edge 226. At the side edges 228 and 230 of the closure flap 222 and adjoining the resealable flap portion 238 are a pair of modified glue tabs 240 and 242. Glue tabs 240 and 242 are joined to resealable flap 238 along their front edges 244 and 246 at hinge lines 248 and 250.

Top edges 252 of glue tabs 240 and 242 are inclined downwardly from top edge 226. Edges 254 are vertical and extend from inclined edge 252 downwardly past upper line of weakness 236. Bottom edge 256 of glue tabs 240 and 242 extends horizontally from edge 254 about half the length of edge of 254 and then forms an inclined edge 258 and joins another horizontal edge portion 260 which joins edges 244 and 246 at the intersection with upper line of weakness 236.

The above-described structural design provides enlarged glue tabs 240 and 242 for an enlarged engagement surface with cover flap end panels 262 of cover flap 264 and edge portions 256 and 258 correspond and shape to edge portions 266 and 268 respectively of cover panel end flap 262.

While this invention has been described as having a preferred design it is understood that it is capable of further modifications, uses and/or adaptations of the invention following in general the principle of the invention and including such departures from the present disclosure as come within known or customary practice in the art to which the invention pertains, and as may be applied to the central features hereinbefore set forth, and fall within the scope of the invention and the limits of the appended claims.

We claim:

1. A blank for forming a carton for packaging ice cream or the like comprising:

a) connected cover, front, bottom and rear panels;

b) said cover and bottom panels having front, rear, left and right edges;

c) said front and rear panels having each having top, bottom, left and right edges;

d) a closure flap hingedly connected to said front edge of said cover panel;

e) said rear panel being hingedly connected at its top edge to said rear edge of said cover panel;

f) said bottom panel being hingedly connected at its rear edge to said bottom edge of said rear panel;

g) said front panel being hingedly connected at its bottom edge to said front edge of said bottom panel;

h) said panels each including left and right end flaps connected to said left and right edges respectively forming hinge lines therebetween;

i) said left and right end flaps including top, bottom, rear and front edges;

j) said left end flaps being dimensioned such that when folded, the left end of the carton is substantially sealed;

k) said right end flaps being dimensioned such that when folded, the right end of the carton is substantially sealed;

l) a closure panel connected to said cover panel;

m) said closure panel including top, bottom, left and right edges;

n) said closure panel being connected along its top edge to said front edge of said cover panel;

o) said closure panel including left and right end glue tabs hingedly connected to its left and right edges and a tear strip extending across said closure panels and parallel to said top edge of said closure panel;

p) said left and right end tabs including extensions spaced laterally from said closure flap for providing a larger adhesive application surface area, and g) wherein said tear strip includes a top edge and a bottom edge and said extensions terminate between said top edge and said bottom edge of said tear strip.

* * * * *